US006895695B1

(12) United States Patent
Chen

(10) Patent No.: US 6,895,695 B1
(45) Date of Patent: May 24, 2005

(54) SHOE STRUCTURE

(76) Inventor: Hsin Kuo Chen, No. 31, Lane 81, Sanjyun St., Shulin City, Taipei County (TW) 238

( * ) Notice: Subject to any disclaimer, the term of this patent is extended or adjusted under 35 U.S.C. 154(b) by 0 days.

(21) Appl. No.: 10/720,866

(22) Filed: Nov. 21, 2003

(51) Int. Cl.[7] ..... A43B 21/24
(52) U.S. Cl. ..... 36/24.5; 36/34 R
(58) Field of Search ..... 36/24.5, 36 R, 36/36 C, 40, 41, 42, 34 R

(56) References Cited

U.S. PATENT DOCUMENTS 1,860,437 A * 5/1932 Thelen ..... 36/19 A
2,037,613 A * 4/1936 Book ..... 36/34 R
2,135,844 A * 11/1938 Quirk ..... 36/34 R
2,159,602 A * 5/1939 Quirk ..... 36/34 R
4,272,897 A * 6/1981 Ponce ..... 36/24.5
4,848,008 A * 7/1989 Kuehnle et al. ..... 36/35 R
6,023,858 A * 2/2000 Srourian ..... 36/42

* cited by examiner

*Primary Examiner*—Ted Kavanaugh

(57) ABSTRACT

A shoe structure mainly includes a sole, a heel, and a vamp adapted to enclose at least part of a wearer's foot. A reinforcing plate is embedded in the sole to extend from a rear end to a near-middle point of the sole for bearing a downward force from a suspended rear half of the wearer's foot, and a cushion pad is connected to a lower end of the heel. The sole is provided on the rear end with a recess for receiving a fixing plate therein. A screw is extended through the fixing and the reinforcing plate into an internally threaded tube embedded in the heel, providing an enhanced connecting force between the sole and the heel and preventing the heel from breaking or separating from the sole.

6 Claims, 5 Drawing Sheets

SHOE STRUCTURE

FIELD OF THE INVENTION

The present invention relates to a shoe structure providing an enhanced connecting force between a sole and a heel, and more particularly to a shoe structure including a sole that is provided with a recess for receiving a fixing plate therein, and a heel that is internally provided with a internally threaded tube, so that a screw may be threaded through the fixing plate into the tube to provide an enhanced connecting force between the sole and the heel, preventing the heel from easily separating from the sole.

BACKGROUND OF THE INVENTION

Shoes with heels, particularly high heels, make wearers, particularly women, looked higher and showing better shank curves and a matured and sexy feminine nature. Both male and female consumers are highly interested in heeled shoes.

FIGS. 1 and 2 are exploded perspective and assembled side views, respectively, of a conventional shoe 1 showing the structure thereof.

As shown, the shoe 1 mainly includes a sole 11, a heel 12, and a vamp 13 adapted to enclose at least part of a wearer's foot. A reinforcing plate (not shown) is embedded in the sole 11 to extend from a rear end to a near-middle point of the sole 11, so as to bear a downward force from a suspended rear half of the wearer's foot. A lower end of the heel 12 is provided with a cushion pad 121. The heel 12 is generally connected to a rear lower end of the sole 11 by means of nailing a fastening means 111 having pointed pins vertically provided at all corners thereof through the rear end of the sole 11 into a top of the heel 12. Adhesive may be applied over a contact surface between the sole 11 and the heel 12 before the fastening means 111 is nailed into the heel 12. Alternatively, the sole 11 and the heel 12 may be tightly connected to each other by directly nailing a plurality of nails through the sole 11 into the heel 12.

The above-described shoe structure has been used for several decades. However, since the fastening means 111 either has insufficient fixing ability or is inaccurately nailed, and the heel 12 is not always strong enough to support the wearer's weight, the heel 12 tends to separate from the sole 11 or even break when the shoe 1 has been used over a period of time and the heel 12 is impacted by an external force or improperly stepped on an uneven surface. The separated or broken heel 12 would inevitably embarrass the wearer. It is therefore desirable to develop an improved shoe structure to eliminate the drawbacks existed in the conventional shoe structure.

SUMMARY OF THE INVENTION

A primary object of the present invention is to provide a shoe structure providing an enhanced connecting force between a sole and a heel, so that the heel is not subject to the risk of easily separating from the sole.

To achieve the above and other objects, the shoe structure of the present invention mainly includes a sole, a heel, and a vamp adapted to enclose at least part of a wearer's foot. A reinforcing plate is embedded in the sole to extend from a rear end to a near-middle point of the sole for bearing a downward force from a suspended rear half of the wearer's foot, and a cushion pad is connected to a lower end of the heel. The sole is provided on the rear end with a recess for receiving a fixing plate therein. A screw is extended through the fixing and the reinforcing plate into an internally threaded tube embedded in the heel, providing an enhanced connecting force between the sole and the heel and preventing the heel from breaking or separating from the sole.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
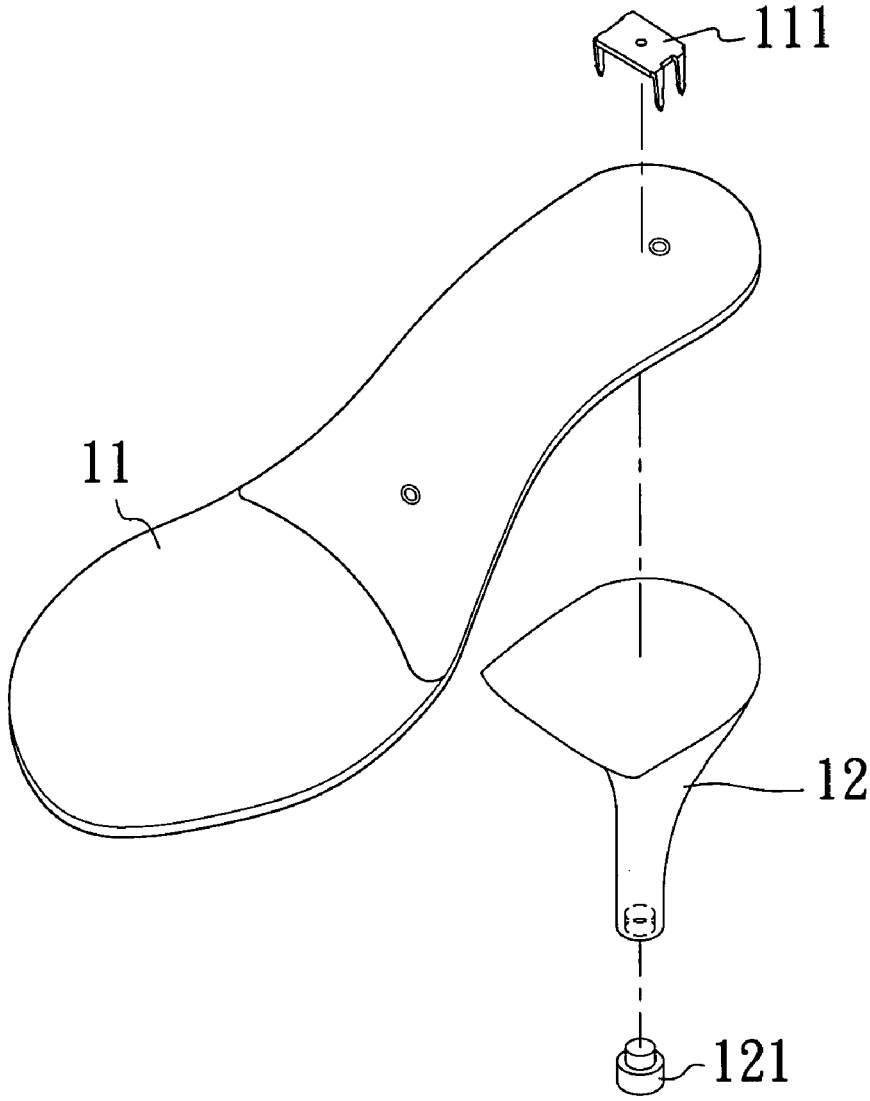
(PRIOR ART) Fig. 1
FIG. 1 is an exploded perspective view of a conventional shoe structure.
Figure 2:
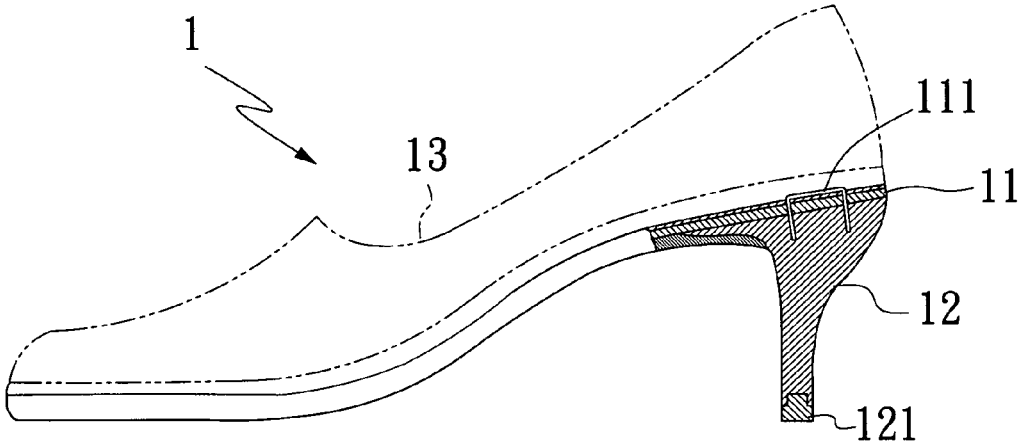
(PRIOR ART) Fig. 2
FIG. 2 is an assembled side view of FIG. 1.
Figure 3:
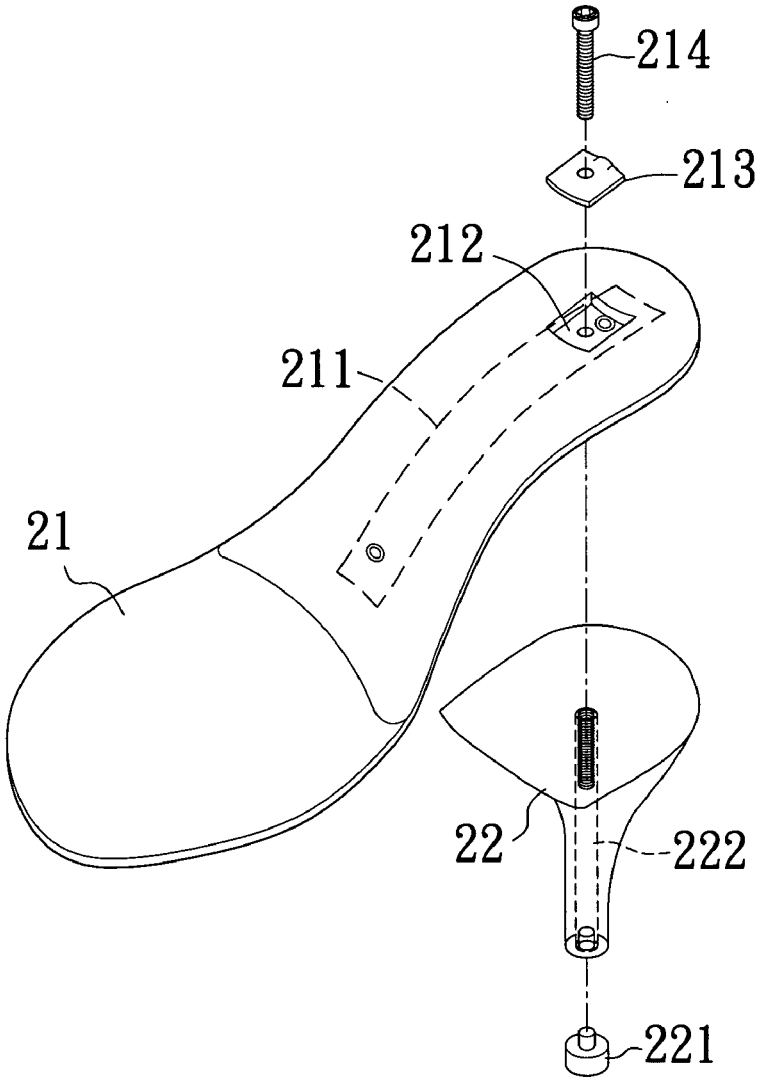
FIG. 3 is an exploded perspective view of a shoe structure according to a first embodiment of the present invention.
Figure 4:
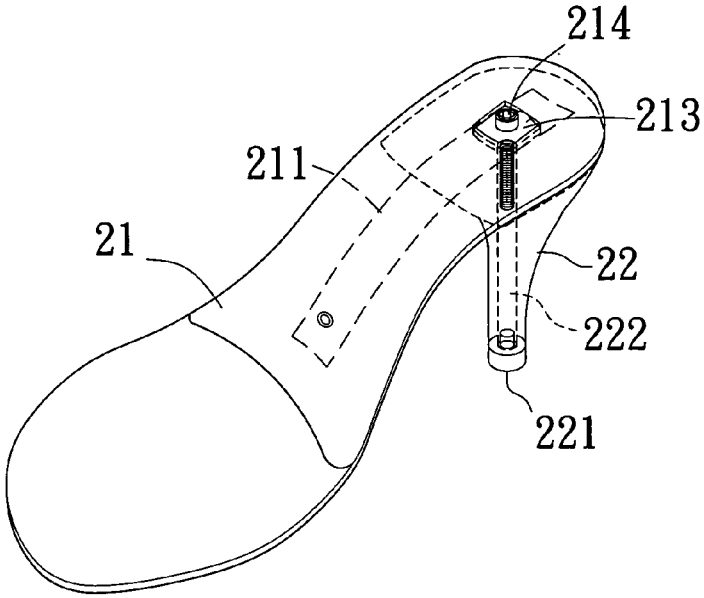
FIG. 4 is an assembled perspective view of FIG. 3.
Figure 5:
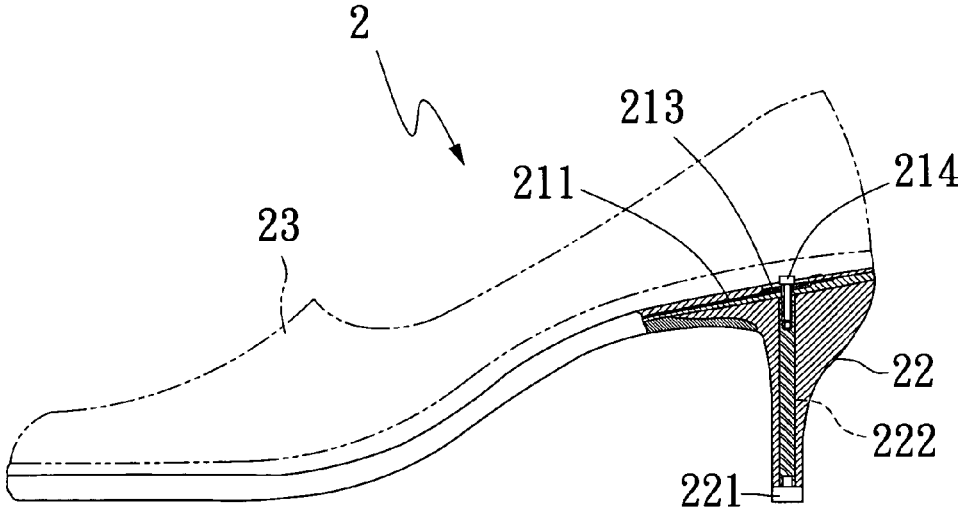
FIG. 5 is an assembled side view of FIG. 3.

Please refer to FIGS. 3, 4, and 5 which are exploded perspective, assembled perspective, and assembled side views, respectively, of a shoe structure 2 according to a first embodiment of the present invention.

Figure 6:
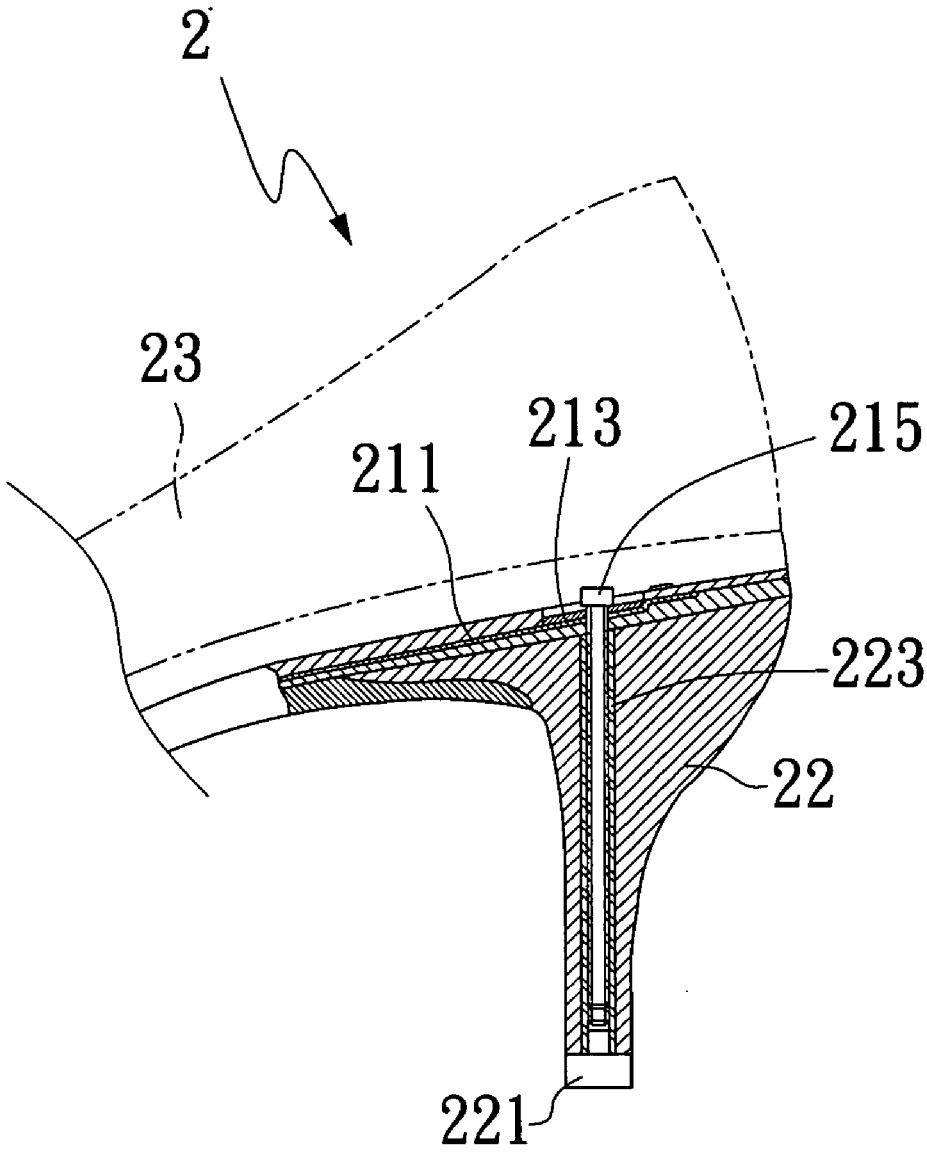
FIG. 6 is a fragmentary and enlarged side view of a shoe structure according to a second embodiment of the present invention.

As shown, the shoe structure 2 mainly includes at least a sole 21, a heel 22, and a vamp 23 adapted to enclose at least part of a wearer's foot. A reinforcing plate 211 is embedded in the sole 21 to extend from a rear end to a near-middle point of the sole 21, so as to bear a downward force from a suspended rear half of the wearer's foot. A cushion pad 221 is connected to a lower end of the heel 22. The sole 21 is provided at the rear end above the heel 22 with a recess 212, into which a fixing plate 213 is set. A screw 214 is downward extended through two holes correspondingly provided on the reinforcing plate 211 and the fixing plate 213 into an internally threaded tube 222 embedded in the heel 22. The tube 222 is provided in an upper one third part with internal threads for the screw 214 to quickly screw into the tube 222. In a second embodiment of the present invention shown in FIG. 6, which is a fragmentary and enlarged side view of the shoe 2, an internally threaded tube 223 having an extended length is embedded in the heel 22, and a long screw 215 is screwed into a full length of the internally threaded tube 223. Either the internally threaded tube 222 or 223 may have a round, or a square, or a polygonal outer peripheral wall, on which a plurality of uneven lines or patterns may be provided to enable the tube 222 or 223 to tightly associate with the heel 22 to form one body when the heel 22 is injection-molded.

In the above-illustrated embodiments, the shoe structure 2 is implemented as a high-heeled shoe for women. However, it is understood the shoe structure 2 may also be implemented as any other type of shoe having a heel.

The internally threaded tube 222, 223 may be made of a metal material having a high rigidity, such as a steel tube, to enhance the connecting force between the sole 21 and the heel 22, and strengthen the heel 22 so that the heel 22 is not subject to separation from the sole 21 or breaking due to impaction by an external force or stepping on an uneven surface.

What is claimed is:

1. A shoe structure, comprising a sole, a heel, and a vamp adapted to enclose at least part of a wearer's foot; said sole having a reinforcing plate embedded therein to extend from a rear end to a near-middle point of said sole to bear a downward force from a suspended rear half of the wearer's foot, and said heel having a cushion pad connected to a lower end; said shoe structure being characterized in that:

said sole is provided at said rear end above said heel with a recess for receiving a fixing plate therein, two through holes are correspondingly provided on said fixing plate and said reinforcing plate for a screw to downward extend therethrough into said heel, and that said heel is internally provided with an internally threaded tube for engaging with said screw.

2. The shoe structure as claimed in claim 1, wherein said internally threaded tube has an outer peripheral wall, a shape of which is selected from the group consisting of round, square, and polygonal shapes.

3. The shoe structure as claimed in claim 1, wherein said internally threaded tube is provided on an outer peripheral wall with a plurality of uneven lines or patterns to enable tight association of said tube with said heel when said heel is injection-molded.

4. The shoe structure as claimed in claim 1, wherein said shoe structure is a high-heeled shoe.

5. The shoe structure as claimed in claim 1, wherein said shoe structure is a leather shoe.

6. The shoe structure as claimed in claim 1, wherein said shoe structure is a heeled shoe.

* * * * *